US005529230A

United States Patent [19]

Smith

[11] Patent Number: 5,529,230

[45] Date of Patent: Jun. 25, 1996

[54] SELF-SUPPORTING LUMBAR PACK

[75] Inventor: Patrick D. Smith, Golden, Colo.

[73] Assignee: MountainSmith, Inc., Golden, Colo.

[21] Appl. No.: 291,586

[22] Filed: Aug. 15, 1994

[51] Int. Cl.[6] ..... A45F 3/14

[52] U.S. Cl. ..... 224/625; 224/153; 224/660; 224/580

[58] Field of Search ..... 224/224, 240, 224/231, 236, 202, 208, 210, 211, 213; 383/33, 119; 150/107, 108, 109, 110, 136; 190/115, 127

[56] References Cited

U.S. PATENT DOCUMENTS

| | | | |
|---|---|---|---|
| 1,522,269 | 1/1925 | Recker | 190/127 |
| 2,061,091 | 11/1936 | Roth | 190/127 |
| 4,029,243 | 6/1977 | Zerobnick et al. . | |
| 4,332,379 | 6/1982 | Bannister . | |
| 4,424,841 | 1/1984 | Smith | 224/240 |
| 4,449,654 | 5/1984 | Cappis . | |
| 4,545,414 | 10/1985 | Baum . | |
| 4,951,818 | 8/1990 | Johnson | 190/127 |
| 5,025,965 | 6/1991 | Smith | 224/151 |
| 5,228,609 | 7/1993 | Gregory | 224/224 |
| 5,236,112 | 8/1993 | Robinson et al. | 224/210 |

FOREIGN PATENT DOCUMENTS

| | | | |
|---|---|---|---|
| 480573 | 4/1992 | European Pat. Off. | 224/208 |
| 948855 | 8/1949 | France | 150/130 |
| 1355725 | 2/1964 | France | 224/210 |

*Primary Examiner*—Henry J. Recla
*Assistant Examiner*—Gregory M. Vidovich
*Attorney, Agent, or Firm*—Robert G. Crouch; Chrisman, Bynum & Johnson

[57] ABSTRACT

A lumbar pack having a bag and a waistbelt attached to the bag and including an elongated, flexible, semi-rigid support member flexed into a curved shape and received within the bag. The support member is of sufficient height when in this curved shape to extend from the buttocks of the user to the thoracic region of the user. A pair of adjustable straps are provided, one on either of opposite sides of the pack, to adjust the pack into a position adjacent the lumbar region of the user. When in this adjusted position, the flexible support member serves to bring the upper portion of the bag against the thoracic region of the user's back. The support member may include a pair of elongated delrin rods. The bag includes a front and a back interior wall with top edges folded over to form pockets therein for receiving the ends of the flexed rods so as to retain the rod within the compartments.

14 Claims, 3 Drawing Sheets

SELF-SUPPORTING LUMBAR PACK

This invention relates to a lumbar pack with a flexible frame, and more particularly to a flexible frame which holds the pack open and supports the load against the back of the user.

BACKGROUND OF THE INVENTION

Lumbar packs combine some of the advantageous features of backpacks that have shoulder straps with fanny packs that have only a waistbelt. These lumbar packs are taller than fanny packs so that they may have the same volume or capacity as a small backpack with shoulder straps (day pack), but they carry the load on the person's hips rather than hanging the load on the person's shoulders. Consequently, lumbar packs have become popular for cyclist, climbers, and other athletic and recreational users by allowing the user to carry a significant load without restraining or burdening the chest and shoulders with the shoulder straps of a backpack.

As lumbar packs are made larger, however, the fit of the pack against the user's back is not optimal. The increased height of the lumbar pack results in a significant portion of the pack being located above and somewhat rearwardly from the waistbelt connection to the pack. In addition, as packs are made larger, the weight of the load carried therein increases similarly. This combination of a large load being vertically and rearwardly offset from the connection point of the pack to the supporting waistbelt results in a force couple with a downward vector extending through the center of gravity of the load and an upward vector extending through the connection point that tends to pivot the pack away from the user's back, which force couple is resisted only by the waistbelt. The load and pack are free to bounce and shift when in this position away from the user's back, causing fatigue and discomfort to the user. A conventional waistbelt attachment has insufficient rigidity and strength to provide much stability or resistance to such bouncing and shifting.

Consequently, the inventor of the present application developed an improvement for tall lumbar packs, disclosed in U.S. Pat. No. 5,025,965, wherein a diagonal strap is extended at an angle from an upper portion of the lumbar pack downwardly and forwardly to an attachment on the waistbelt that is spaced a distance forward from the connection of the waistbelt to the pack. The strap is adjustable so that the pack and load can be pulled snugly into a position against the user's back. The strap greatly improves the stabilization of lumbar packs against the back of the user.

The improvement realized by the diagonal strap is limited, however, by the position of the diagonal strap on the lumbar pack. The area of the pack located above the connection point to the diagonal strap remains unsupported. As a consequence, it is possible for the top of the pack which has no structural rigidity to fold and slump away from the user's back.

While frames have traditionally been used to provide support for all types of backpacks, they are not standardly used with lumbar packs. The added weight from a frame would be very undesirable in a lumbar pack, and frames are typically stiff and inflexible so that they do not conform to the contours of the user's back as the user bends and flexes during bicycle riding or hiking over rough terrain. Therefore, such traditional frames cause discomfort to the user.

Another disadvantage common to most lumbar packs in a lack of a means to retain the pack in an upright position to facilitate access to the inner compartment or compartments of the lumbar pack. Due to the pliant-sided nature of most lumbar packs, they tend to slump and droop when unsupported, such as when removed from the user. These characteristics are not conducive to access to the interior of the lumbar pack for inserting or removing objects into or from the lumbar pack.

SUMMARY OF THE INVENTION

Accordingly, it is an object of the present invention to provide an improved lumbar pack that is self-supporting along substantially all of its height to a position against the lumbar region of the user's back.

It is another object of this invention to provide a lightweight, flexible frame which can be flexed to conform in shape and contour to fit against the curved "small" of any user's back, whatever the shape of the particular user's back.

It is a further object of this invention to provide a self-supporting lumbar pack which retains an upright position to facilitate access to the inner compartment or compartments of the pack.

Additional objects, advantages, and novel features of this invention shall be set forth in part in the description that follows, and in part will become apparent to those skilled in the art upon examination of the following description or may be learned by the practice of the invention. The objects and the advantages of the invention may be realized and attained by means of the instrumentalities and combinations particularly pointed out in the appended claims.

To achieve the foregoing and other objects and in accordance with the purposes of the present invention, as embodied and broadly described herein, the lumbar pack of this invention may comprise a bag for carrying objects and a waistbelt attached to the bag. An elongated, resilient support member that is flexible yet semi-rigid is positioned within the bag after being flexed into a curved u-shape. The support member is of sufficient height when in this curved shape to extend from the buttocks of the user to the thoracic region of the user. A pair of adjustable straps, one located on each of the opposite sides of the lumbar pack, interconnect the waistbelt at a location forward of the pack adjacent the hip of the user with the bag at a point adjacent the lumbar region of the user. The straps are adjustable to pull the central portion of the pack against the lumbar region of the user and to thereby flex the support member against its resilient bias to conform in contour to the natural curvature of user's back in the lumbar region. This forced curvature of the midportion of the support member with the bottom portion positioned immovably against the user's buttocks forces the upper portion of the support member to bias the upper portion of the pack toward the thoracic region of the user's back. The support member includes a pair of elongated delrin rods.

Another aspect of the lumbar pack of the present invention includes a bag with an opening defined therein and attached to a waistbelt. The bag also has defined therein an inner front compartment and an inner back compartment. Each of the inner front and back compartments of the bag each receive one of a pair of elongated, resilient support members which are flexible yet semi-rigid. The semi-rigid support members serve to maintain the bag in an upright position and maintain the opening in an open position.

Further refinements of the invention include the bag being composed of a plurality of panels including a front panel, a pair of side panels, a bottom panel, a back panel, all stitched together to form an open-sided box. A front interior wall and a back interior wall are provided within the bag adjacent the corresponding front and back panels. The space between the front panel and the front interior wall defines the front compartment which receives one of the pair of support members while the space between the back panel and the back interior wall defines the back compartment which receives the other of the pair of support members. A top panel or flap is provided to selectively close the opening into the pack.

BRIEF DESCRIPTION OF THE DRAWINGS

The accompanying drawings, which are incorporated in and form a part of the specification, illustrate preferred embodiments of the present invention and, together with the description, serve to explain the principles of the invention. In the drawings.

DETAILED DESCRIPTION OF THE PREFERRED EMBODIMENT

Figure 2:
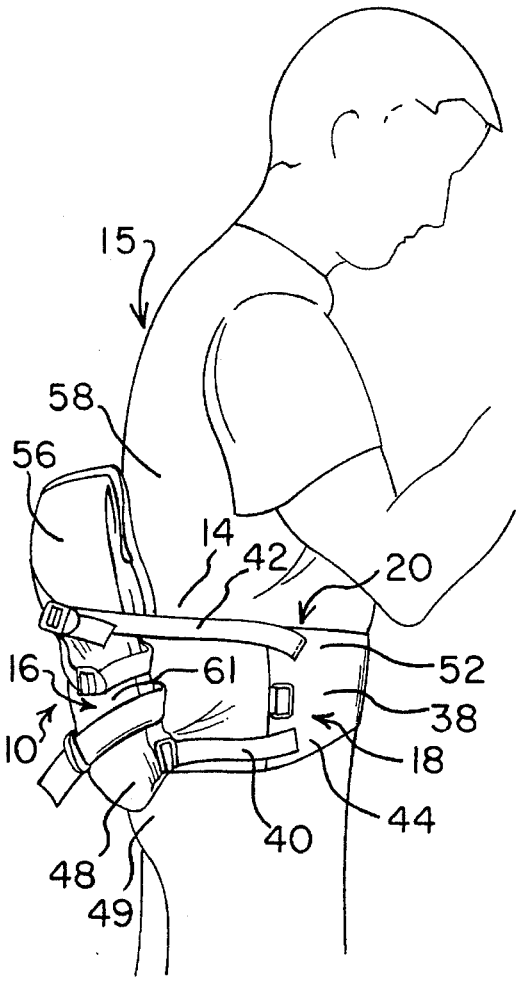
FIG. 2 is a right side elevation view of the lumbar pack shown in FIG. 1 illustrating the pack in a relaxed position adjacent the lower back of the user.
Figure 5:
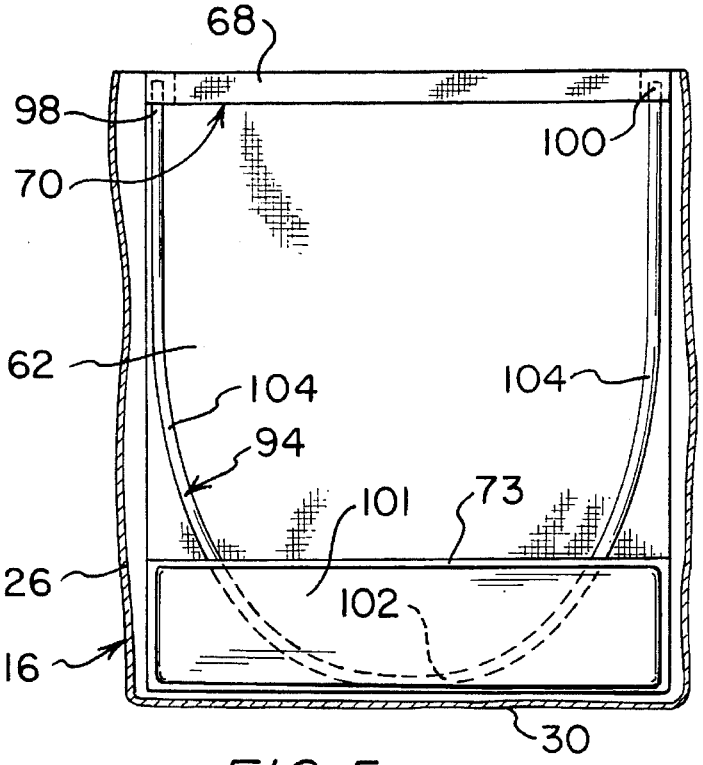
FIG. 5 is a cross-sectional view taken along line 5—5 of FIG. 4 of the lumbar pack of the present invention and showing a portion of the resilient, flexible frame thereof.
Figure 6:
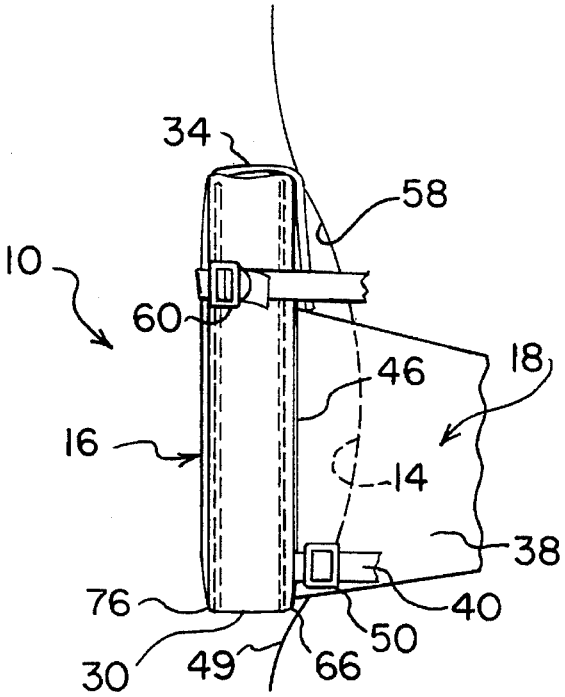
FIG. 6 is an enlarged side elevation view of the lumbar pack shown in FIG. 2 and showing the pack in a relaxed position.
Figure 7:
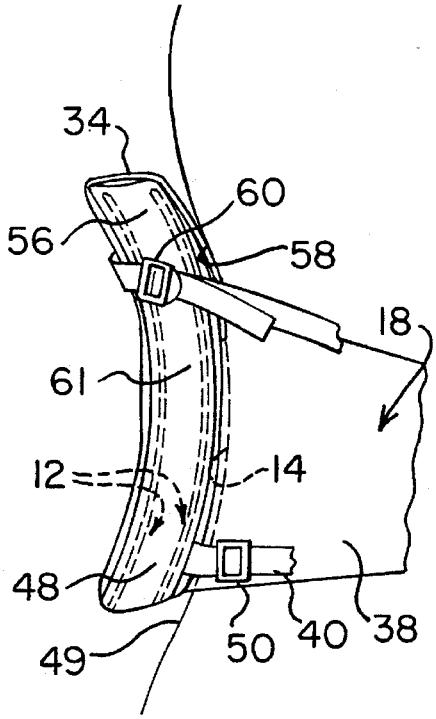
FIG. 7 is an enlarged side view of the lumbar pack shown in FIG. 3 and showing the lumbar pack in a tightened position flexed and fitting snugly against the user's back with the bottom portion of the support member anchored in immovable position against the user's buttocks, the midportion pulled by the diagonal straps against its natural bias into the "small" of the person's back, and the top portion reflexively biasing the top of the bag against the thoracic region of the user's back.

The lumbar pack 10 of the present invention, shown in FIGS. 1–7, features a flexible frame 12 (FIG. 6) to support the pack in an upright position when free standing and used in combination with a pair of diagonal straps 42 to also flex the pack into a contoured fit against the user's back 15 (FIG. 2) when the straps 42 are properly adjusted. As best seen in FIGS. 2 and 6, the pack 10 includes a bag 16 or container for carrying objects, a waistbelt 18 attached to the bag 16 for connection about and support by the waist 20 of the user, and the flexible frame 12 including a pair of flexible rods 94 and 96 positioned in the bag 16.

Figure 1:
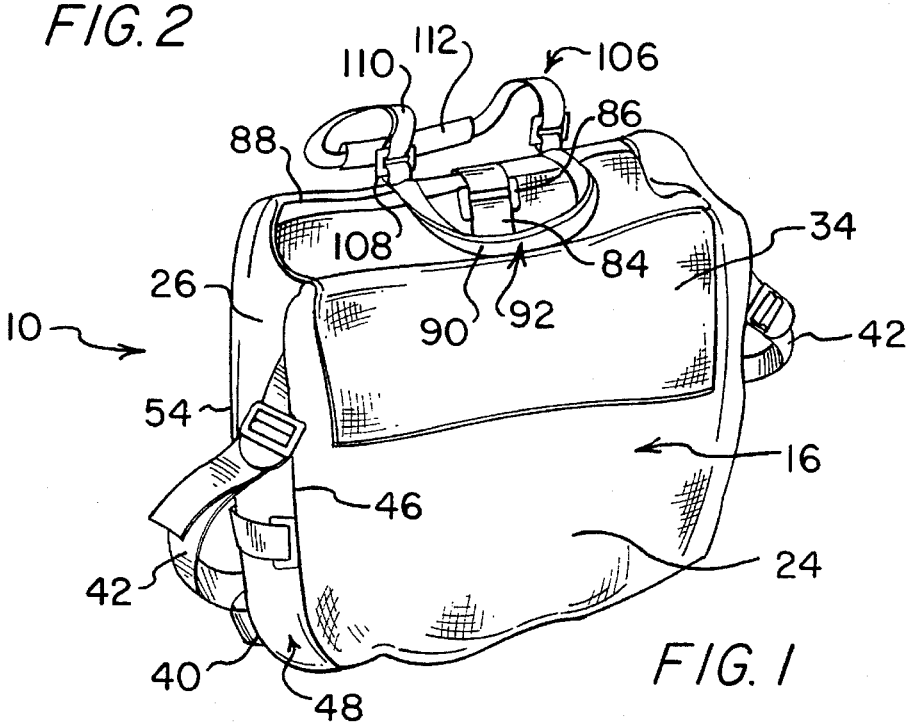
FIG. 1 is a perspective view of the lumbar pack of the present invention showing a back panel of the lumbar pack to which a pair of diagonal straps are attached.
Figure 4:
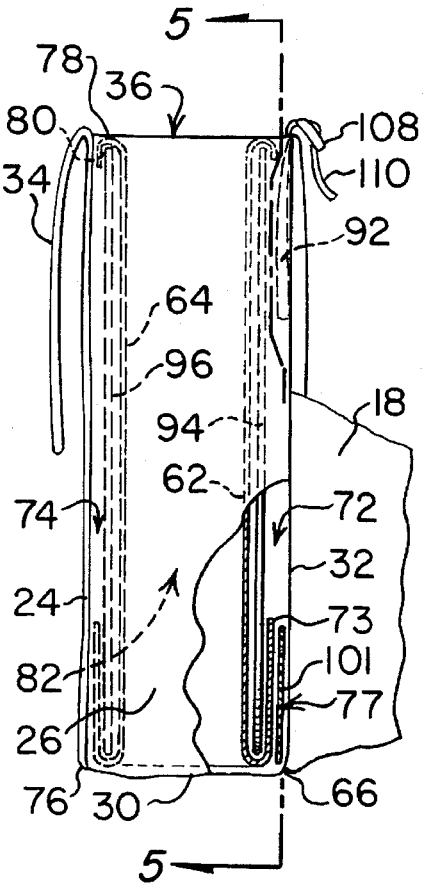
FIG. 4 is a right side elevation view of the lumbar pack of the present invention showing the flexible frame thereof in phantom lines.

The bag 16, best seen in FIGS. 1, 4, and 5, includes a front panel 32 facing the back 15 of the user, a pair of side panels 26, a bottom panel 30 stitched to the front panel 32, and a back panel 24 stitched to the side panels 26 and bottom panel 30. A top panel or flap 34 is stitched only to the back panel 24 and can be utilized to open and close an opening 36 defined by the upper edges of the front panel 32, back panel 24, and side panels 26. A pair of releasable connectors (not shown) are located on facing sections of the flap 34 and side panels to provide a convenient means of closure to secure the flap 34 in a closed position. Conventional pile and loop releasable connectors are preferably utilized for this purpose. Each of the panels described above are preferably composed of cordura or similar material.

The waistbelt 18, shown in FIGS. 2 and 6, is stitched to the front panel 32 of the bag 16. The waistbelt 18 includes two sides 38 (only one of which is shown) which may be fastened together to secure the lumbar pack 10 around the waist 20 and/or hips of the user. The waistbelt 18 may preferably be of the type disclosed in U.S. Pat. No. 5,025,965 issued to the inventor of the present invention and incorporated herein by reference U.S. patent application Ser. No. 08/291,587.

Figure 3:
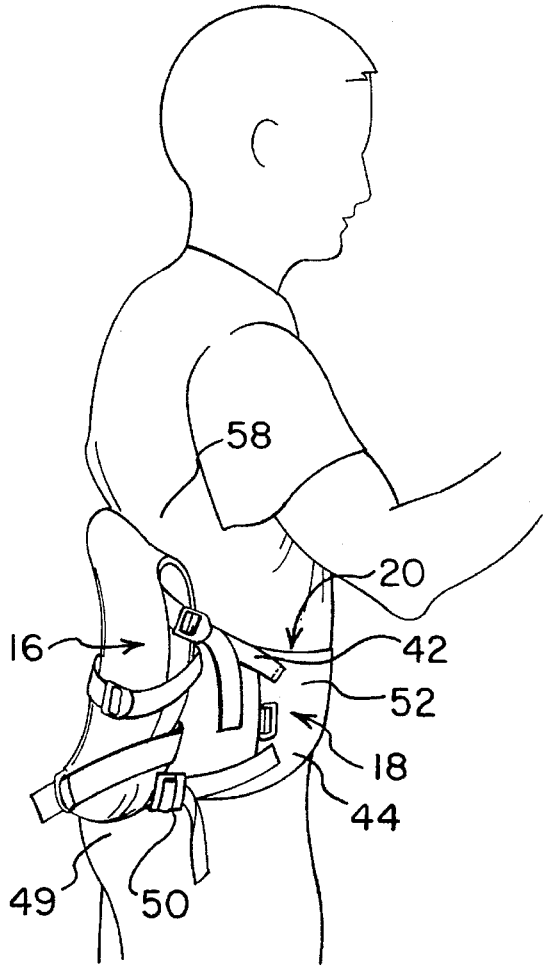
FIG. 3 is a right side elevation view of the lumbar pack of the present invention shown in FIG. 1 illustrating the pack in a position tightened against the lower back of the user by the combination of support member and diagonal straps according to the present invention and particularly showing the flexed position of the pack after tightening of the diagonal straps to pull the pack snugly against the small of the user's back.

Each side 38 of the waistbelt 18 is also connected to the bag 16 by two adjustment straps—a lower adjustment strap 40 and the upper adjustment or diagonal strap 42, as shown in FIGS. 2 and 3. The lower adjustment strap 40 is attached between a lower section 44 of the waistbelt 18 adjacent the hipbone (not shown) of the user and a seam 54 joining the side panel 26 and the front panel 32 of the bag 16. The point of connection of the lower adjustment strap 40 to the bag 16 is near a lower portion 48 of the bag 16 adjacent the buttocks 49 of the user. A buckle 50 is provided on the lower adjustment strap 40 through which the strap 40 can be lengthened or shortened as desired.

The upper adjustment strap 42 is attached between an upper section 52 of the waistbelt 18 adjacent the hipbone of the user and a point on the bag 16 on a seam 46 where the back panel 24 of the bag 16 is stitched to the side panel 26 of the bag 16. The point of connection on the seam 54 is on an upper portion 56 of the bag 16 corresponding to the thoracic region 58 or upper lumbar region of the user, depending upon the height of the bag 16 and user. A buckle 60 is provided on the upper adjustment strap 42 so that the strap 42 may be manipulated therethrough to shorten or lengthen the strap 42 as desired. Corresponding straps 40 and 42 are provided on the opposite side of the pack 10 as shown in FIG. 1. A central portion 61 of the bag 16 extends between the lower and upper portions 48 and 56 of the bag 16, respectively.

As shown in FIG. 4, the interior of the bag 16 is divided into three separate compartments by a pair of interior walls—a front interior wall 62 and a back interior wall 64. The front interior wall 62 is parallel to and adjacent the front panel 32 of the bag 16 and is stitched thereto at the seam 54 where the front panel 32 joins with the side panel 26 and at a seam 66 where the front panel 32 is stitched to the bottom panel 30. A top edge 68 of the front interior wall 62 is folded over and is stitched into the seam 54 as well, forming a pocket 70 on the front interior wall 62, which extends across the entire width of the wall 62. A front compartment 72 is thus formed and defined by the space between the front interior wall 62 and the front panel 32. Within the front compartment, an intermediate wall 73 is stitched to the seams 66 and 54 to form a first and second lower pocket 75 and 77 therein (FIGS. 4 and 5).

Similarly, as shown in FIG. 4, the back interior wall 64 is provided to define a back compartment 74 in the bag 16. The back interior wall 64 is parallel to and adjacent the back panel 24 of the bag 16 and is stitched thereto at the seam 46 where the back panel 24 joins with the side panel 26 and at a seam 76 where the back panel 24 is stitched to the bottom panel 30. A top edge 78 of the back interior wall 64 is folded over and is stitched into the seam 46 as well, forming a pocket 80 on the back interior wall 64, which extends across the entire width of the wall 64. The back compartment 74 is thus formed and defined by the space between the back interior wall 64 and the back panel 24.

A center or main compartment 82 is formed and defined by the space between the front interior wall 62, the back interior wall 64, and the side panels 26. Preferably, the center compartment 82 will be utilized to carry objects (not shown) as desired by the user.

As shown in FIG. 1, the front interior wall 62 can selectively be fastened to the front panel 32 by a fabric strip 84 containing corresponding portions of a releasable pile and loop connector (not shown). An end of the fabric strip 84 is stitched to the back interior wall 64. A plastic loop 86 is appended from a top edge 88 of the front panel 32 and is used for releasable attachment to the fabric strip 84, which extends between the top edges 68 and 88 of the back interior wall 64 and back panel 24, respectively.

A sturdy but flexible loop 90 of material, as shown in FIGS. 5 and 6, is stitched at either end to two spaced apart positions along the top edge 88 of the front panel 32 to provide a convenient carrying handle 92 for the lumbar pack 10. The handle 92 can be folded so as to be received within the front compartment 74 of the lumbar pack 10, and the above-described fabric strip 84 with the releasable connector can be fastened to retain the handle 92 within the front compartment 74. Selectively and alternatively, the releasable connector can be unfastened, and the handle 92 may be deployed for carrying the pack 10 in the user's hand when not attached about the waist and hips of the user.

Figure 10:
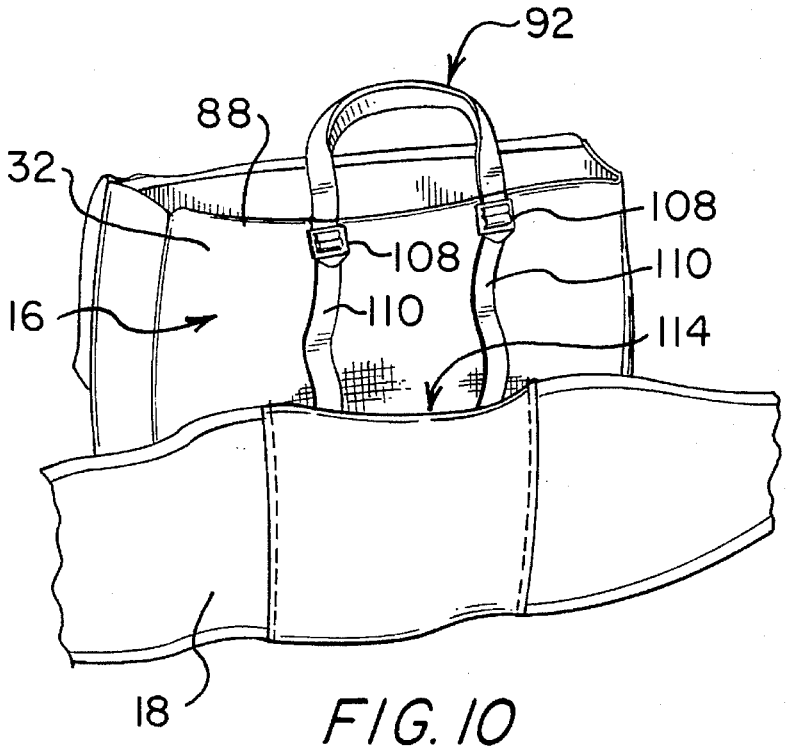
FIG. 10 is a perspective view of the lumbar pack showing the shoulder sling stowed in a storage pocket behind the waistbelt.

A shoulder sling 106, as shown in FIGS. 1 and 10, is attached to the top edge 88 of the front panel 32 by a pair of buckles 108 stitched to the top edge 88. The sling includes a flexible strap 110 and a cushioned central portion 112 for resting on the shoulder of the user as an alternative to carrying by the handle 92 or with the waistbelt 18. When not in use, the sling 106 can either be removed at the buckles 108 or stowed in a storage pocket 114 defined between the waistbelt 18 and the front panel 32.

Figure 8:
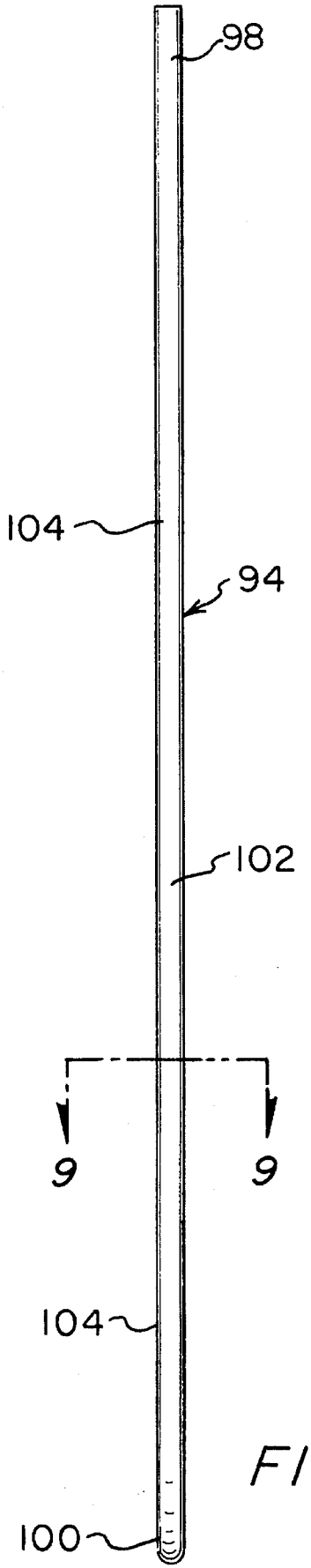
FIG. 8 is a top plan view of one of the delrin rods of the flexible frame as initially formed and before being flexed into a curved shape as seen in FIG. 5.
Figure 9:
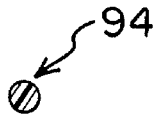
FIG. 9 is a cross-sectional view taken along line 9—9 of FIG. 8 showing the circular cross-sectional shape of the delrin rod of the flexible frame.

The flexible frame 12 includes the pair of elongated, resilient, flexible rods—the front rod 94 and the back rod 96—composed of delrin or high density polyethylene. Each of the rods 94 and 96 is formed in a straight or cylindrical shape, as shown in FIGS. 8 and 9, and weighs less than two ounces. The rods have the characteristic of being relatively stiff and rigid over relatively short distances but resiliently flexible across relatively larger distances. The front rod 94 is flexed and received within the front compartment 72 in a vertically-oriented U-shape so that the free ends 98 and 100 of the rod 94 point upward. Because of the shape in which the rods 94 and 96 are formed and the resilience of the material of which they are made, they tend to be biased toward returning to the straight position. The front rod 94 may be inserted through the opening 36 of the bag 16 into the front compartment 72 and manipulated until each of the free ends 98 and 100 of the front rod 94 are received within the pocket 70 defined across the top edge 68 of the front interior wall 62 and a curved midportion 102 of the front rod 94 fits within the first lower pocket 75.

Similarly, the back rod 96 is received within the back compartment 74 in a vertically-oriented U-shape so that the free ends 98 and 100 of the rod 96 point upward. The back rod 96 may be inserted through the opening 36 of the bag 16 into the back compartment 74 and manipulated until each of the free ends 98 and 100 of the back rod 96 are received within the pocket 80 defined across the top edge 78 of the back interior wall 64. Each rod 94 and 96 is not only biased toward returning to a straight line orientation but is also biased toward retaining a planar orientation when in the U-shape.

A plastic diffuser plate 101 can be inserted into the second lower pocket 77 as shown in FIG. 5. The plate 101 rests between the rods 94 and 96 and the use's buttocks 49 so as to reduce discomfort therefrom by spreading the force across the plate 101.

It can be appreciated from FIGS. 4–6 that the lumbar pack 10 is self-supporting when free standing as a result of the flexible frame 12. The rods 94 and 96 in the front and back compartments 72 and 74, respectively, serve to support the lumbar pack 10 by holding it in a substantially continuous and vertically- and horizontally-spread orientation due to the semi-rigid nature of each rod 94 and 96.

The supporting function of the frame 12 when the pack 10 is being worn by the user is effected by tightening the adjustment straps 40 and 42, and particularly the upper adjustment strap 42, as best seen in FIGS. 2, 3, 6, and 7. The lumbar pack 10 positioned on the user's waist 20 with the straps 40 and 42 in a relaxed position is illustrated in FIGS. 2 and 6. As can be seen in FIG. 3, after the upper adjustment strap 42 is tightened to pull the upper portion 56 of the bag 16 against the thoracic or upper lumbar region 58 of the user, the resilient rods 94 and 96 in the pack 10 are bowed against their resilient bias into a curved shape to fit the rods 94 and 96 snugly against the small 14 of the back of the user. At the same time, the curved midportions 102 of the rods 94 and 96 are positioned immovably in abutting relation to the user's buttocks 49, so the forced curvature of the leg portions 104 of the rods 94 and 96 in the small of the back 14 against the resilient bias of the rods 94 and 96, causes the free ends 98 and 100 of the rods 94 and 96 to force the upper portion 56 of the bag 16 snugly against the thoracic region 58 of the user's back. The amount of curvature of the leg portions 104 of the rods 94 and 96 will vary depending upon the amount that the adjustment straps 40 and 42 are adjusted and the amount of curvature in the back of the particular user wearing the lumbar pack 10. The portion of the lumbar pack 10 above the attachment point of the upper adjustment strap 42 is held in place against the thoracic region 58 of the user's back by the ends 98 and 100 of the flexible frame 12 due to the semi-rigid nature of the flexible rods 94 and 96. The weight of the load (not shown) and bag 16, which would otherwise cause the upper portion 56 of the bag 16 to droop or sag away from the user's back is counteracted by the spring force or bias of the flexible rods 94 and 96 which bias the upper portion 56 of the bag 16 against the user's back. It can be appreciated that the same effects of curving the frame 12 to fit the user's back and biasing the upper portion 56 of the bag 16 against the user's back could be obtained with only a single one of the two rods 94 and 96.

As can be seen, the flexible frame 12 in the lumbar pack 10 of the present invention provides for a pack 10 that is adaptable to fit snugly against a wide range of contours of users' backs from the bottom of the pack 10 to the top of the pack 10 as well as to flex and conform to the changing contour of a user's back as the user bends and straightens, such as during bicycle riding, hiking over rough terrain, bending to pick up objects, and the like. Further, the flexible frame 12 is lightweight, so it does not add any significant weight to the pack 10. Also, the frame 12 provides for a self-supporting pack 10 in a substantially continuous and vertically- and horizontally-spread direction when the pack 10 is free standing. The height of the lumbar pack 10 of the present invention can be reduced, or the height of the user can be great. In either case, the upper portion 56 of the bag 16 may be adjacent to a point in the lumbar at upper lumbar region of the user. The invention will still function as described in this situation.

The foregoing is considered illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to as falling within the scope of the invention as defined by the claims which follow.

The invention claimed is:

1. A lumbar pack for wearing around the waist and against the lumbar region of a user, comprising:

a bag adapted for wearing against the lumbar region of the user and extending from at least the buttocks to the thoracic region of the user, wherein the bag includes an upper portion, a central portion, and a lower portion and the bag further has a front side which is placed against the body of the user and a back side which is opposite from the front side;

a waistbelt attached to the bag and adapted for encircling the waist of the user;

a pair of elongated, flexible, semi-rigid rods flexed into a curved-shape and received within the bag, each rod being of sufficient height when in the curved-shape to extend from the buttocks to the thoracic region of the user to provide support to the bag and assist in maintaining the bag in a position against the body of the user, one rod associated with and supporting the front side of the bag and the other associated with and supporting the back side of the bag, the rods being in substantial parallel alignment with each other; and a pair of adjustable straps, one each on opposite sides of the pack, each interconnecting the waistbelt at a point adjacent the hip of the user with the bag at a point adjacent the lumbar region of the user, whereby tightening of the straps places the central portion of the bag in close proximity to the lumbar region of the user and flexes the flexible rods to follow the natural curvature of the user's back in the lumbar region so that the upper portion of the bag is yieldingly urged toward the thoracic region of the user's back.

2. A lumbar pack as defined in claim 1, wherein the elongated rods are composed of delrin.

3. A lumbar pack as defined in claim 1, wherein the curved-shape into which the rods are flexed in a u-shape.

4. A lumbar pack for wearing around the waist and adjacent the lumbar region of a user, comprising:

a bag having an opening defined therein, the bag including an inner front compartment, an inner back compartment, and a center compartment therebetween, the center compartment adapted to contain objects;

a waistbelt attached to the bag and adapted for encircling the waist of the user; and a pair of elongated, flexible, semi-rigid support members flexed into a curved-shape and received within the bag, the inner front compartment receiving one of the pair of support members and the inner back compartment receiving the other of the pair of support members;

whereby the semi-rigid support members assist in maintaining the inner front compartment and the inner back compartment in substantially parallel planar orientations when not on the back of the user and thus assist in maintaining the bag in an upright position.

5. A lumbar pack as defined in claim 4, wherein the bag further includes;

a front panel;

a pair of side panels attached to the front panel;

a bottom panel attached to the front and side panels;

a back panel attached to the bottom and side panels;

a front interior wall attached to the bag and located adjacent to the front panel, the front compartment being defined by the space between the front panel and the front interior wall; and a back interior wall attached to the bag and located adjacent to the back panel, the back compartment being defined by the space between the back panel and the back interior wall.

6. A lumbar pack as defined in claim 5, wherein the front interior wall is shaped to form a pocket along a top edge thereof to retain an end of one of the elongated support members therein and further wherein the back interior wall is shaped to form a pocket along a top edge thereof to retain an end of the other of the elongated support members therein.

7. A lumbar pack as defined in claim 6, wherein each of the pair of support members is flexed into a u-shape.

8. A lumbar pack as defined in claim 7, wherein the pair of support members are received within the bag in an upright, u-shaped orientation with both of the ends of each of the pair of support members retained within the pockets on the interior walls.

9. A lumbar pack as defined in claim 5, further including:

a top panel attached to the back panel; and means for selectively and removably attaching the top panel to the bag to close the opening.

10. A lumbar pack as defined in claim 4, further including:

a handle pivotably attached to the front panel so that the handle is adapted to be stored within the inner front compartment of the bag and adapted to be selectively deployed into a position outside the bag for carrying the pack by hand.

11. A lumbar pack as defined in claim 5, further including;

a pair of buckles attached to the front panel in spaced apart relation;

an elongated shoulder sling attached at either end to the spaced apart pair of buckles on the front panel.

12. A lumbar pack as defined in claim 11 wherein the attachment of the waistbelt to the bag defines a storage pocket therebetween for storage of the shoulder sling.

13. A lumbar pack, comprising:

a bag having an opening defined therein, the bag including an inner front compartment and an inner back compartment, wherein the bag further includes;

a front panel;

a pair of side panels attached to the front panel;

a bottom panel attached to the front and side panels;

a back panel attached to the bottom and side panels;

a front interior wall attached to the bag and located adjacent to the front panel, the inner front compartment being defined by the space between the front panel and the front interior wall, the front interior wall further being shaped to define a pocket along a top edge thereof;

a back interior wall attached to the bag and located adjacent to the back panel, the back compartment being defined by the space between the back panel and the back interior wall, the back interior wall further being shaped to define a pocket along a top edge thereof; and an intermediate wall within the front compartment, the intermediate wall being attached to the bag adjacent to the front panel and front interior wall, the intermediate wall defining a first lower pocket between the intermediate wall and the front panel and a second lower pocket between the intermediate wall and the front interior wall;

a waistbelt attached to the bag;

a pair of elongated, flexible, semi-rigid support members flexed into a curved-shape and received within the bag, the inner front compartment receiving one of the pair of support members and the inner back compartment receiving the other of the pair of support members, wherein each of the pair of support members is flexed into a u-shape having distal ends and a curved portion therebetween and received within the respective compartments in an upright, u-shaped orientation with both of the distal ends of the support members retained within the pockets on the respective interior walls whereby the support members assist in maintaining the bag in an upright position; and a diffuser plate received within the first lower pocket;

wherein the curved midportion of the support member which is received within the front compartment is received within the second lower pocket.

14. A lumbar pack for wearing around the waist and against the lumbar region of a user, comprising:

a bag adapted for wearing against the lumbar region of the user and extending from at least the buttocks to the thoracic region of the user, the bag having an upper portion, a pair of side portions, and a lower portion, the upper portion of the bag defining an upper opening in the bag;

a waistbelt attached to the bag and adapted for encircling the waist of the user to support the bag and allow the bag to be carried by the user; and an elongated, flexible, semi-rigid support member flexed into a curved-shape which is a u-shape, the support member having distal ends and a curved portion therebetween and received within the bag so that the curved portion is adjacent the lower portion of the bag and the distal ends are adjacent the upper portion of the bag, the support member serving to spread the upper portion of the bag from side to side so as to maintain the opening in an open position from side to side by biasing the side portions of the bag away from each other, the support member being of sufficient height when in the curved-shape to extend from the buttocks to the thoracic region of the user to provide support to the bag, particularly side-to-side and vertical support to the upper portion of the bag on either side to assist in maintaining the upper portion of the bag in a position against the back of the user.

* * * * *